US008127576B2

(12) United States Patent
Yoon et al.

(10) Patent No.: US 8,127,576 B2
(45) Date of Patent: Mar. 6, 2012

(54) LAUNDRY MACHINE

(75) Inventors: Ju Han Yoon, Changwon-si (KR); Dong Geun Lee, Changwon-si (KR); Sang Hun Bae, Changwon-si (KR); Seon Il Heo, Changwon-si (KR); Yeon Sik Choi, Changwon-si (KR); Sang Jin Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 973 days.

(21) Appl. No.: 12/149,764

(22) Filed: May 7, 2008

(65) Prior Publication Data

US 2008/0282751 A1 Nov. 20, 2008

(30) Foreign Application Priority Data

May 9, 2007 (KR) ..... 10-2007-0045136
Jan. 3, 2008 (KR) ..... 10-2008-0000780

(51) Int. Cl.
*D06F 37/00* (2006.01)

(52) U.S. Cl. ..... 68/5 R; 68/20

(58) Field of Classification Search ..... 68/12.12, 68/12.18, 17 R, 20, 205 R, 5 R; 137/493.2–493.4
See application file for complete search history.

(56) References Cited

U.S. PATENT DOCUMENTS

| | | | | |
|---|---|---|---|---|
| 3,335,751 | A * | 8/1967 | Davis, Jr. | 137/541 |
| 3,756,273 | A * | 9/1973 | Hengesbach | 137/540 |
| 2004/0187527 | A1* | 9/2004 | Kim et al. | 68/5 C |
| 2007/0151310 | A1* | 7/2007 | Wright et al. | 68/3 R |

FOREIGN PATENT DOCUMENTS

| | | |
|---|---|---|
| DE | 34 08 136 A1 | 9/1985 |
| FR | 2213702 | 8/1974 |
| KR | 10-0698132 | 3/2007 |
| KR | 10-0774219 | 11/2007 |
| WO | WO 2008/007889 | 1/2008 |
| WO | WO 2008/010671 | 1/2008 |

* cited by examiner

*Primary Examiner* — Michael Barr
*Assistant Examiner* — Saeed T Chaudhry
(74) *Attorney, Agent, or Firm* — McKenna Long & Aldridge LLP

(57) ABSTRACT

A laundry machine is disclosed. The disclosed laundry machine includes a drum rotatably provided in a cabinet, a substance supply device provided in the cabinet and supplying moisture to the drum, a water supply device supplying water to the substance supply device, and a valve unit provided in the water supply device, to selectively allow water from the water supply device to be supplied to the substance supply device.

15 Claims, 8 Drawing Sheets

LAUNDRY MACHINE

This application claims the benefit of Korean Patent Application Nos. 10-2007-0045136 filed on May 9, 2007 and 10-2008-0000780 filed on Jan. 3, 2008, which is hereby incorporated by reference as if fully set forth herein.

BACKGROUND OF THE INVENTION

1. Field of the Invention

The present invention relates to a laundry machine, and more particularly to a laundry machine capable of removing creases from laundry during a drying operation for the laundry, and effectively supplying water from a water supply device under the condition in which the water supply device is connected to the laundry machine.

2. Discussion of the Related Art

Typically, a laundry dryer, which is a kind of a laundry machine, is a home appliance used to dry laundry, mainly clothes, completely washed, using hot air. Generally, such a laundry dryer includes a drum for accommodating laundry to be dried therein, and a drive source for driving the drum, a heater for heating air introduced into the drum, and a blower unit for sucking air into the drum or outwardly discharging air from the drum.

Laundry dryers may be classified into an electric type and a gas type in accordance with the type of the system for heating air, namely, the type of the heater. The electric type laundry dryer heats air, using heat generated from an electrical resistance. On the other hand, the gas type laundry dryer heats air, using heat generated in accordance with the combustion of gas.

Laundry dryers may also be classified into a condensation type and an exhaustion type. In the condensation type laundry dryer, air, which has become humid after being heat-exchanged with laundry to be dried in the drum, is circulated without being outwardly discharged. The air is heat-exchanged with ambient air through a separate condenser. In accordance with this heat exchange, condensed water is generated, and is then outwardly discharged. In the exhaustion type laundry dryer, air, which has become humid after being heat-exchanged with laundry to be dried in the drum, is directly discharged to the outside of the laundry dryer.

Laundry dryers may also be classified into a top loading type and a front loading type in accordance with the laundry loading type. In the top loading type laundry dryer, laundry to be dried is loaded into the laundry dryer through the top of the laundry dryer. On the other hand, in the front loading type laundry dryer, laundry to be dried is loaded into the laundry dryer through the front side of the laundry dryer.

Meanwhile, conventional laundry dryers as mentioned above have the following problems.

Typically, in a laundry dryer, laundry spin-dried after being completely washed is loaded so that it can be dried. In this case, the laundry, which has been washed using water, has creases due to the principle of the water washing. In the drying procedure carried out in the laundry dryer, however, the creases cannot be completely removed. In order to remove the creases still present on objects, such as laundry, completely dried in conventional drying machines, it is necessary to perform ironing.

Where clothes other than laundry completely washed are stored or used in a typical manner, creases, rumples, or holds (hereinafter, generally referred to as "creases") may be formed at the clothes. To this end, it has been required to develop an apparatus capable of conveniently removing creases generated during the storage or use of clothes.

SUMMARY OF THE INVENTION

Accordingly, the present invention is directed to a laundry machine that substantially obviates one or more problems due to limitations and disadvantages of the related art.

An object of the present invention is to provide a laundry machine capable of avoiding the formation of creases on clothes, etc. and/or removing creases formed on clothes, etc.

Another object of the present invention is to provide a laundry machine capable of more effectively supplying water from a water supply device under the condition in which the water supply device is connected to the laundry machine.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine comprises: a drum rotatably provided in a cabinet; a substance supply device provided in the cabinet and supplying moisture to the drum; a water supply device supplying water to the substance supply device; and a valve unit provided in the water supply device, to selectively allow water from the water supply device to be supplied to the substance supply device.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
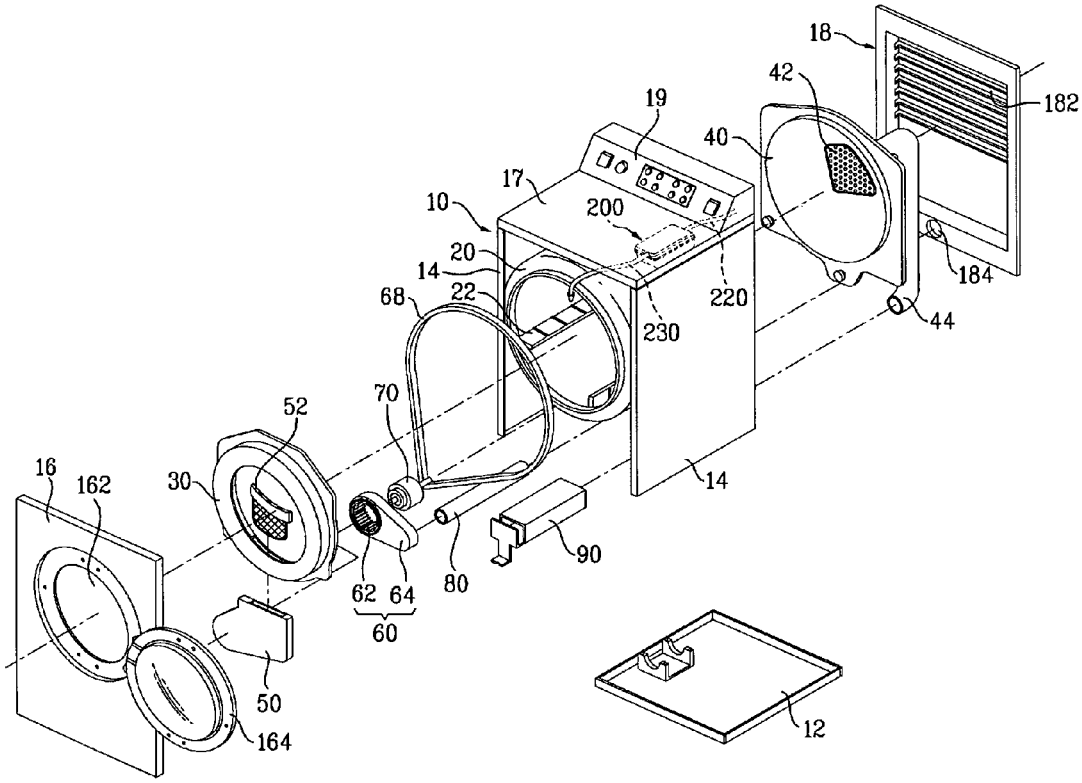
FIG. 1 is an exploded perspective view illustrating a configuration of a laundry machine according to an exemplary embodiment of the present invention.

FIG. 1 is an exploded perspective view illustrating a configuration of a laundry machine according to an exemplary embodiment of the present invention. Hereinafter, the laundry machine according to the illustrated embodiment of the present invention will be described with reference to FIG. 1.

A cabinet 10 forms an outer structure of the laundry machine according to the present invention. The laundry machine may be a laundry dryer. Various constituent elements of the laundry machine are arranged in the interior of the cabinet 10. These constituent elements will be described hereinafter.

That is, a rotatable drum 20 may be installed in the cabinet 10. A motor 70 and a belt 68, which are adapted to drive the drum 20, may also be installed in the cabinet 10. An air heater 90 may be arranged in the cabinet 10 at a desired position, to heat air, and thus to generate hot air. A hot air supply duct 44 may also be arranged in the cabinet 10, to supply the hot air generated by the air heater 90 to the drum 20. In the cabinet 10, an exhaust duct 80 for exhausting humid air heat-exchanged with objects to be dried in the drum 20, and a blower unit 60 for sucking the humid air may also be arranged. Meanwhile, a substance supply device may be arranged in the cabinet 10 at a desired position, to supply moisture, e.g., mist or steam to the drum 20.

Although an indirect drive type, in which the motor 70 and belt 68 are used to rotate the drum 20, is illustrated and described in this embodiment, the present invention is not limited thereto. That is, a direct drive type, in which a motor is directly connected to a rear wall of the drum 20, to directly rotate the drum 20, may be applied to the present invention.

Hereinafter, the above-described constituent elements will be described in more detail.

The cabinet 10, which forms the outer structure of the laundry machine, may include a base 12 forming a bottom wall, a pair of side covers 14 extending vertically from the base 12, a front cover 16 mounted to the front ends of the side covers 14, a rear cover 18 mounted to the rear ends of the side covers 14, and a top cover 17 disposed on the upper ends of the side covers 14. A control panel 19, which includes various operating switches or the like, may be arranged on the top cover 17 or front cover 16. A door 164 may be mounted to the front cover 16. A louver 182 is provided at the rear cover 18, to introduce ambient air into the cabinet 10. An exhaust hole 184 is also provided at the rear cover 18, as a passage for finally discharging air from the drum 20 to the outside of the drum 20.

The interior of the drum 20 functions as a drying chamber, in which a drying operation is carried out. A lift 22 may be installed in the drum 20, to drop laundry after raising the laundry such that the laundry is turned over, and thus to achieve an enhancement in drying efficiency.

Meanwhile, a front supporter 30 and a rear supporter 40 may be installed between the drum 20 and the cabinet 10, namely, between the drum 20 and the front cover 16 and between the drum 20 and the rear cover 18, respectively. The drum 20 is rotatably installed between the front supporter 30 and the rear supporter 40. Sealing members (not shown) are fitted between the front supporter 30 and the drum 20 and between the rear supporter 40 and the drum 20, respectively, to prevent water leakage. That is, the front supporter 30 and rear supporter 40 close the front and rear ends of the drum 20, to define the drying chamber in the drum 20. The front supporter 30 and rear supporter 40 also function to support the front and rear ends of the drum 20.

An opening may be formed through the front supporter 30, to communicate the drum 20 with the outside of the laundry machine. The opening is selectively opened or closed by the door 164. A lint duct 50, which is a passage for outwardly discharging air from the drum 20, is connected to the front supporter 30. A lint filter 52 may be installed in the lint duct 50.

One side of the blower unit 60 is connected to the lint duct 50. The other side of the blower unit 60 is connected to the exhaust duct 80. The exhaust duct 80 communicates with an exhaust hole 184 provided at the rear cover 18.

Accordingly, when the blower unit 60 operates, air present in the drum 20 is exhausted from the drum 20 via the lint duct 50, exhaust duct 80, and exhaust hole 184. During this operation, foreign matter such as lint is filtered out by the lint filter 52. Typically, the blower unit 60 includes a blower 62, and a blower housing 64. Typically, the blower 62 is connected to the motor 70, which drives the drum 20.

An opening 42, which is constituted by a plurality of through holes, is formed through the rear supporter 40. A hot air supply duct 44 is connected to the opening 42. The hot air supply duct 44 communicates with the drum 20, to function as a passage for supplying hot air to the drum 20. To this end, the air heater 90 is installed at a certain position in the hot air supply duct 44.

A substance supply device is installed at a desired position in the cabinet 10, to supply moisture, e.g., mist or steam to the drum 20. Thus, the substance supply device functions to supply moisture to the drum 20.

For example, the substance supply device includes a pressure applier, which applies a certain pressure to water supplied to the drum 20, and thus to supply mist to the drum 20 through a nozzle or the like. In this case, the pressure applier may comprise a separate pump. Alternatively, a water supply line may be directly connected to an external city water tap, to apply a certain pressure to water supplied by the water supply line in accordance with a water pressure from the city water tap. When water is supplied under pressure, it can be sprayed into the interior of the drum 20 through a nozzle or the like in the form of mist.

Meanwhile, in the illustrated embodiment of the present invention, a steam generator 200, which generates steam, and supplies the generated steam into the interior of the drum 20, functions as the substance supply device. Hereinafter, the steam generator will be described with reference to the accompanying drawings.

Figure 2:
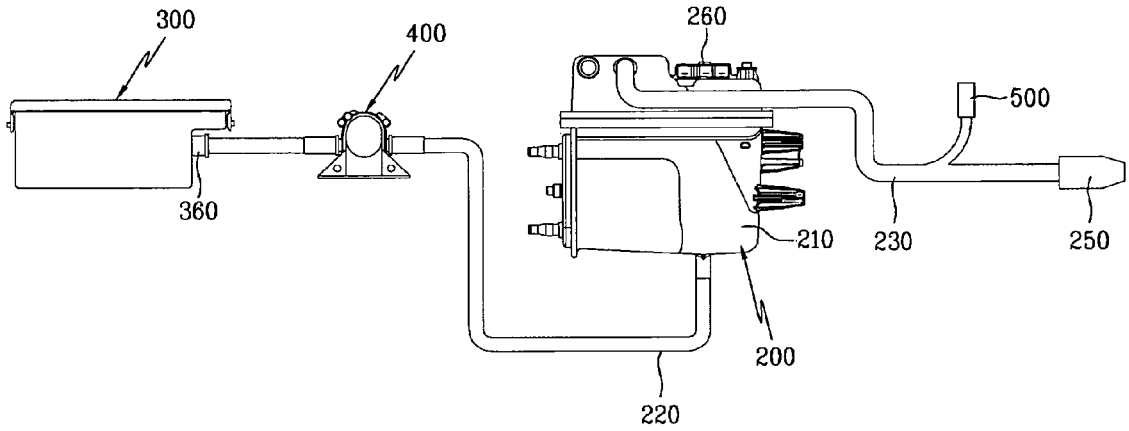
FIG. 2 is a schematic view illustrating a steam generator included in the laundry machine in accordance with an exemplary embodiment of the present invention.

FIG. 2 is a schematic view illustrating a steam generator included in the laundry machine in accordance with an exemplary embodiment of the present invention. Hereinafter, the steam generator according to the illustrated embodiment will be described with reference to FIG. 2.

The steam generator 200 includes a water tank 210 for containing water therein, a heater (not shown) mounted in the water tank 210, a water level sensor 260 for measuring the water level of the steam generator 200, and a temperature sensor (not shown) for measuring the temperature of the steam generator 200. Although not shown, the water level sensor 260 typically includes a common electrode, a low-water-level electrode, and a high-water-level electrode. In this case, the water level sensor 260 senses a high water level or a low water level in accordance with whether the common electrode is electrically connected with the high-water-level electrode or with the low-water-level electrode.

A water supply hose 220 is connected to one side of the steam generator 200, to supply water to the steam generator 200. A steam hose 230 is connected to the other side of the steam generator 200, to discharge steam from the steam generator 200. Preferably, a nozzle 250, which has a certain shape, is arranged at an end of the steam hose 230 opposite to the steam generator 200, to spray steam. Typically, the water supply hose 220 is connected to a water supply device such as a cartridge 300, at an end of the water supply hose 220 opposite to the steam generator 200. The end of the steam hose 230 opposite to the steam generator 200 or the nozzle 250, namely, a steam outlet, is disposed at a desired position in the drum 20, to spray steam into the interior of the drum 20.

In accordance with the illustrated embodiment, the water supply device comprises the cartridge 300, which is separably installed, as described above. Of course, the water supply device may also comprise an external city water tap. Where the water supply device comprises a city water tap, however, there is a difficulty in connecting the steam generator 200 to the city water tap. This is because no water is used in a typical laundry dryer. That is, when the city water tap is used as a water supply device, it is necessary to additionally install various devices associated with the city water tap. Therefore, there is a convenience in the case in which a detachable water supply device, namely, the cartridge 300, is used in such a manner that water is supplied to the water supply device 300 in a separated state of the water supply device 300, and the water-filled water supply device 300 is then connected to the water supply line of the steam generator 200, namely, the water supply hose 220, as in the present embodiment.

Preferably, a pump 400 may be arranged between the water supply device 300 and the steam generator 200. More preferably, the pump 400 is rotatable in normal and reverse directions, not only to supply water to the steam generator 200, but also to recover residual water from the steam generator 200, if necessary. The reason why residual water is recovered from the steam generator 200 is that, when the steam generator 200 is not used for a prolonged period of time, the residual water may cause damage to the heater of the steam generator 200, or may be used in a decomposed state. Preferably, a safety valve 500 is also arranged in a steam line, namely, the steam hose 230, which discharges steam from the steam generator 200.

Hereinafter, an inner structure of the cartridge functioning as the water supply device in the laundry machine of the present invention will be described with reference to the accompanying drawings.

Figure 3:
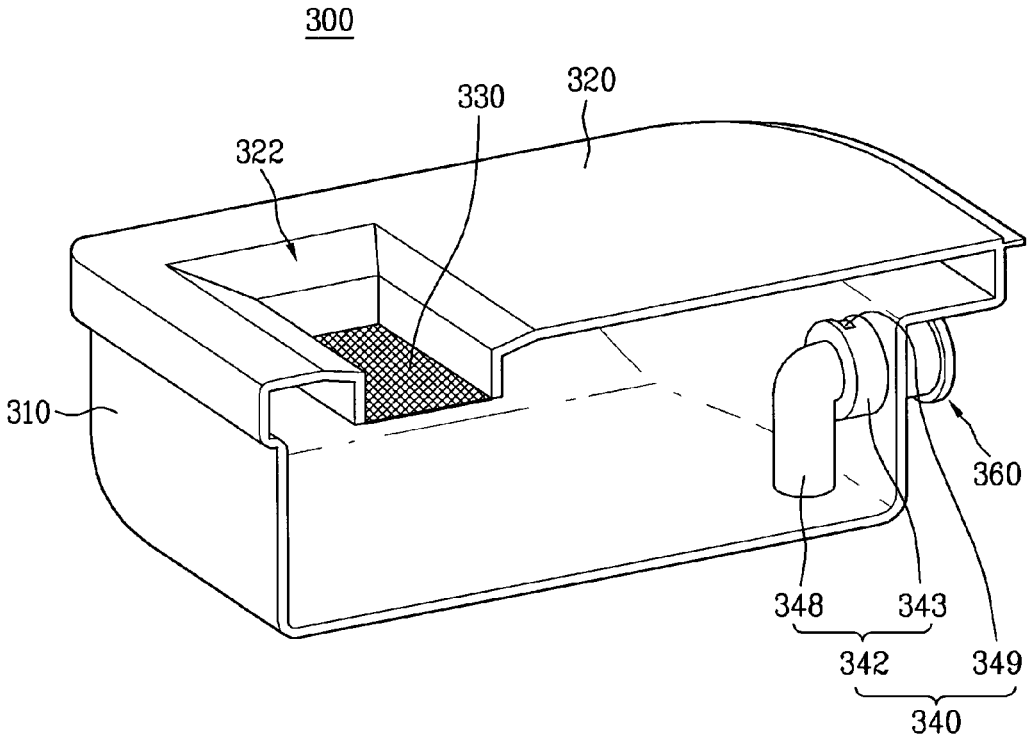
FIG. 3 is a partially-broken perspective view illustrating the interior of a water supply device shown in FIG. 2.

FIG. 3 is a partially-broken perspective view illustrating the interior of the cartridge shown in FIG. 2.

As described above, the laundry machine according to the illustrated embodiment includes the cartridge 300, which is separably connected to the pump 400. In accordance with this configuration, water is supplied to the cartridge 300 which, in turn, supplies the water to the steam generator 200.

The configuration of the separable cartridge will be described with reference to FIG. 3.

The cartridge 300 may include a lower housing 310 for containing water therein, and an upper housing 320 separably coupled to the lower housing 310. When the cartridge 300 is constituted by the lower and upper housings 310 and 320, it is possible to easily remove fur formed on the inner surface of the cartridge 300, and to easily separate a filter 330 or the like, which will be described later, for the cleaning or regeneration thereof.

Preferably, a first filter, namely, the filter 330, may be installed in the upper housing 320. In detail, the first filter 330 is arranged at a water inlet 322 of the upper housing 320, in order to primarily filter water supplied to the cartridge 300.

An outlet member 360 may be provided at the lower housing 310, to selectively supply water from the cartridge 300 to the outside of the cartridge 300. A valve unit 380 (FIG. 4) may be arranged in the outlet member 360. The valve unit 380 functions to prevent water from being outwardly discharged from the cartridge 300 when the cartridge 300 is in a separated state, and to allow water to be outwardly discharged from the cartridge 300 when the cartridge 300 is installed in position. A second filter (not shown) may be connected to the outlet member 360, in order to filter water passing through the outlet member 360. Preferably, the second filter is detachable. A detailed configuration of the valve unit 380 installed in the outlet member 360 will be described in detail later.

In accordance with this embodiment, it is possible to doubly filter out impurities such as fine dust contained in water, using the first filter 330 and the second filter (not shown). A softening member (not shown), which functions to soften water, may be arranged in the cartridge 300. Preferably, the softening member is detachably installed. The softening member functions to remove calcium ions, magnesium ions, etc. contained in water supplied to the steam generator 200 (FIG. 2) when the hardness of the water is high, thereby preventing precipitation of lime from the water.

Meanwhile, the cartridge 300 includes a water supply unit 340 arranged at one side of the cartridge 300 to outwardly supply water from the cartridge 300. The water supply unit 340 may include a pipe member 342 separably connected to the outlet member 360. As described above, the outlet member 360 communicates the outside of the cartridge 300 with the interior of the cartridge 300, to allow water from the cartridge 300 to be outwardly discharged. The water supply unit 340 may also include a coupling member for selectively coupling the pipe member 342 to the outlet member 360.

The outlet member 360 may include an inner portion 362 (FIG. 4) protruded into the interior of the cartridge 300 by a certain length, and an outer portion 366 (FIG. 4) communicating with the inner portion 362 and extending outwardly from the cartridge 300 by a certain length.

Meanwhile, the pipe member 342 may be separably connected to the inner portion 362 of the outlet member 360. In detail, the pipe member 342 may include a connecting portion 343 separably connected to the inner portion 362 of the outlet member 360, and an extension portion 348 extending from the connecting portion 343. The extension portion 348 extends from the connecting portion 343 in a bent state. Preferably, the extension portion 348 is bent by 90°.

The coupling member may include a protrusion 349 protruded from an outer peripheral surface of the inner portion 362 of the outlet member 360, and a groove formed at the connecting portion of the pipe member 342, to correspond to the protrusion. When the pipe member 342 is connected to the inner portion 362 of the outlet member 360, the protrusion 349 is engaged in the groove, thereby coupling the pipe member 342 to the outlet member 360.

Where the pipe member 342 is connected to the outlet member 360, it is preferred that the extension portion 348 of the pipe member 342 be positioned to extend vertically with respect to the bottom of the cartridge 300. As the pipe member 342 is positioned to extend vertically with respect to the bottom of the cartridge 300, it is possible to minimize the length of the path of water flowing through the pipe member 342 when the water is outwardly supplied from the cartridge 300, and thus to more easily discharge the water.

Meanwhile, where the cartridge 300 is selectively connected to the pump 400 (FIG. 2), as described above, it is preferred that the valve unit 380 be provided to allow water to be outwardly discharged from the cartridge 300 only when the cartridge 300 is in a state of being connected to the pump 400.

Figure 4:
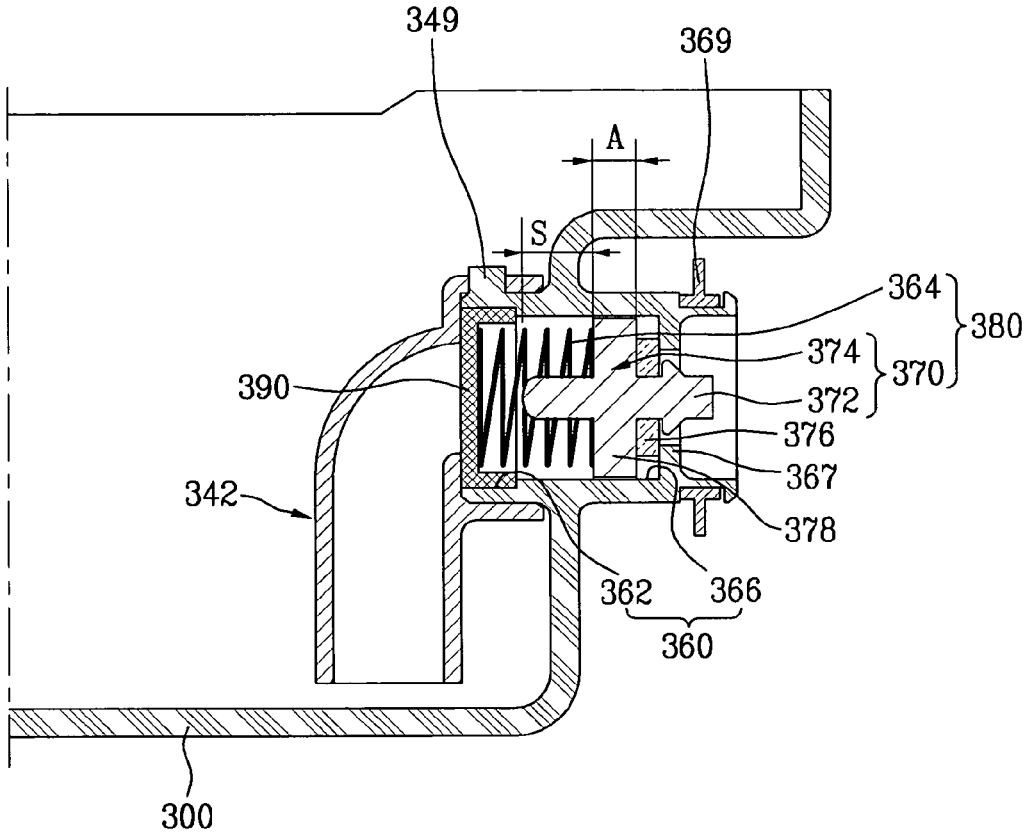
FIG. 4 is a sectional view illustrating a configuration of a valve unit included in the water supply device in accordance with an exemplary embodiment of the present invention.
Figure 5:
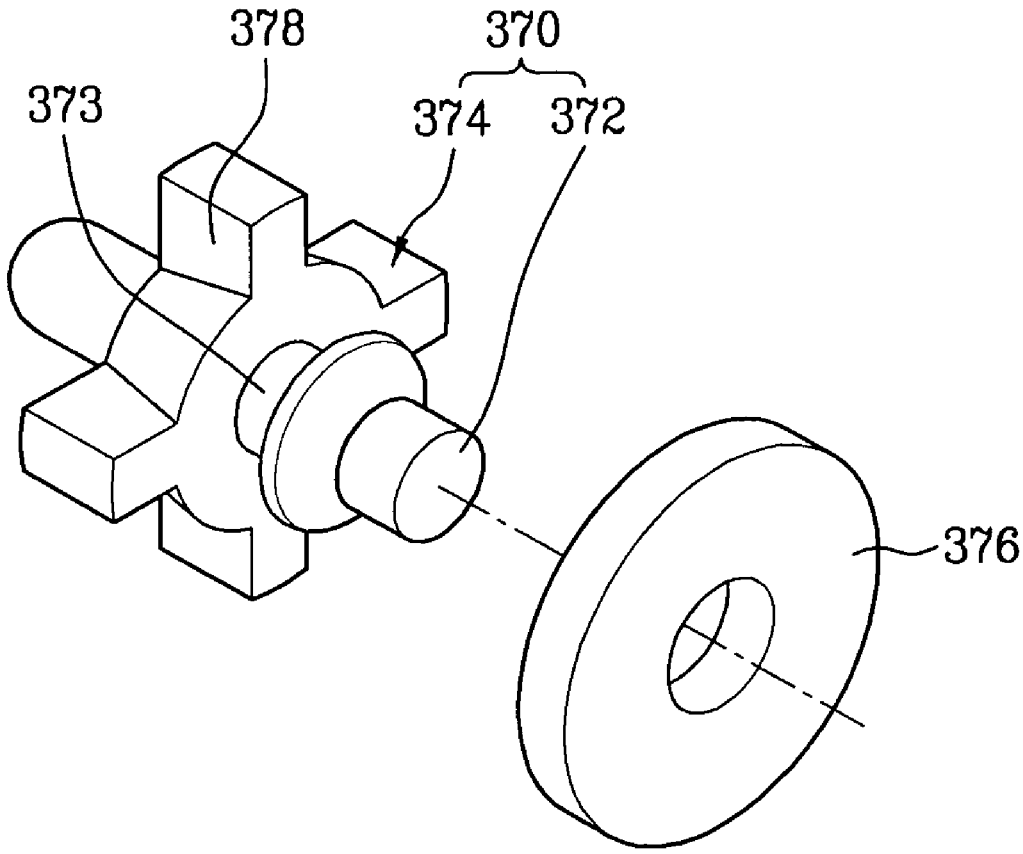
FIG. 5 is a perspective view illustrating a structure of a communicating means according to an exemplary embodiment of the present invention.

FIG. 4 is a sectional view illustrating a configuration of the valve unit arranged in the outlet member of the cartridge in accordance with an exemplary embodiment of the present invention. FIG. 5 is a perspective view illustrating a communicating means and an inner sealing member, which are included in the valve unit.

Referring to FIGS. 4 and 5, the valve unit 380 includes a communicating means 370 arranged in the outlet member 360, to selectively open/close the outlet member 360, and thus to selectively communicate the interior of the cartridge 300 with the outside of the cartridge 300 via the outlet member 360. The valve unit 380 also includes an elastic member 364 for applying an elastic force to the communicating means 370.

The communicating means 370 may include a guide portion 374 formed at one side of the communicating means 370, and an actuating portion 372 formed at the other side of the communicating means 370. A plurality of guide blades 378 may be arranged at the guide portion 374. The guide blades 378 extend radially such that the communicating means 370 is arranged along a central portion of the outlet member 360. That is, the guide blades 378 are in contact with an inner peripheral surface of the outlet member 360, thereby causing the communicating means 370 to be arranged along the central portion of the outlet member 360. Meanwhile, the guide blades 378 are arranged along the guide portion 374 while being circumferentially spaced apart from one another by a certain distance, such that a water passage is defined by the space between the adjacent guide blades 378.

Preferably, each guide blade 378 contacting the inner peripheral surface of the outlet member 360 has a width A in a water flow direction such that the width A substantially corresponds to ⅓ to ⅔ of a maximum distance S, by which the guide blade 378 can move in the outlet member 360 while being in contact with the inner peripheral surface of the outlet member 360 when the outlet member 360 is connected to the pump 40, as will be described later.

The inventors experimentally found that, when the width A of each guide blade 378 in the water flow direction corresponds to the above-described range, the communicating means 370 can move straight in a horizontal direction in the outlet member 360 without being deviated.

That is, it can experimentally be found that, where the width A of each guide blade 378 in the water flow direction does not correspond to the above-described range, the guide portion 374 is misaligned from the outlet member 360 when a tubular protrusion 412 extending from the pump 400 pushes the actuating portion 372 in a direction inclined from the horizontal direction toward the interior of the cartridge 300, thereby causing the communicating means 370 to be jammed in the outlet member 360. However, where the width A of each guide blade 378 in the water flow direction corresponds to the above-described range, the communicating means 370 can smoothly move in the horizontal direction in the outlet member 360 without being deviated, even when the tubular protrusion 412 pushes the actuating portion 372 in a direction inclined from the horizontal direction toward the interior of the cartridge 300.

The actuating portion 372 may be made of an elastic material, for example, a rubber material.

The valve unit 380 may also include an inner sealing member 376 fitted around the communicating means 370. The valve unit 380 may further include an outer sealing member 369 fitted around the outer portion 366 of the outlet member 360. Preferably, the inner sealing member 376 is fixed to the communicating means 370 such that they are operatively connected.

If the inner sealing member 376 is arranged such that it can move independently of the communicating means 370 in the outlet member 360, water may ineffectively flow along the outlet member 360. In this case, the pump 400 (FIG. 2) may be overloaded.

This will be described in more detail. As described above, the pump 400 may be rotatable in normal and reverse directions, not only to supply water from the cartridge 300 (FIG. 2) to the steam generator 300, but also to recover residual water possibly left in the steam generator 200. As the pump 400 repeats normal and reverse rotations, the flow direction of water in the outlet member 360 is repeatedly changed between normal and reverse directions. If the inner sealing member 376 is arranged such that it can move independently of the communicating means 370 in the outlet member 360, the inner sealing member 376 moves in the outlet member 360 irrespective of the communicating means 370 whenever the flow direction of water in the outlet member 360 is changed. As a result, the inner sealing member 376 may close the outlet member 360. When the outlet member 360 is closed by the inner sealing member 376, the water supply efficiency and the residual water recovery efficiency are considerably degraded. Furthermore, the pump 400 may be overloaded, so that the life span thereof may be shortened.

To this end, in accordance with the illustrated embodiment, the inner sealing member 376 is installed such that it is operatively connected to the valve step 370, in order to solve the above-described problems.

In detail, an annular groove 373 may be formed around the communicating means 370 between the actuating portion 372 and the guide portion 374. In this case, the inner sealing member 376 is fitted around the annular groove 373 so that it is fixedly maintained. Since the inner sealing member 376 is fitted around the groove 373 of the communicating means 370, it is operatively connected to the communicating means 370 to move together with the communicating means 370.

Meanwhile, in a state in which the cartridge 300 is disconnected from the pump 400, the elastic member 364 applies an elastic force to the communicating means 370 in the outlet member 360, thereby urging the communicating means 370 toward the outer portion 366 of the outlet member 360, as shown in FIG. 4. In this case, the outer portion 366 of the outlet member 360 is closed by the inner sealing member 376. That is, when the inner sealing member 376, which has an annular shape, receives the elastic force from the elastic member 364, it comes into tight contact with a step 367 formed in the outlet member 366, thereby closing the outer portion 366 of the outlet member 360.

Figure 6:
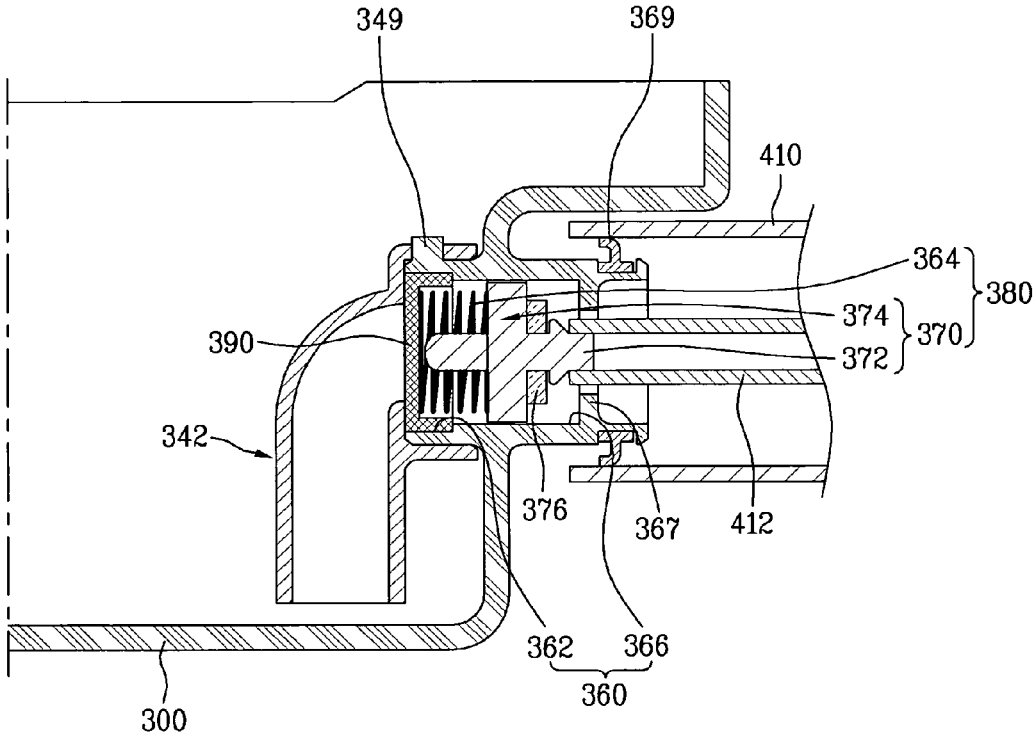
FIG. 6 is a sectional view illustrating an opened state of the valve unit shown in FIG. 4.

FIG. 6 illustrates a state of the valve unit 380 in the outlet member 360 under the condition in which the cartridge 300 is connected to the pump 400.

Referring to FIG. 6, when the cartridge 300 is connected to the pump, in detail, to a pipe 410 extending from the pump 400, the outer member 366 extending from the cartridge 300 is inserted into the pipe 410 such that the outer sealing member 369 comes into contact with an inner peripheral surface of the pipe 410, to provide a sealing effect.

The tubular protrusion 412, which functions to push the actuating portion 372 of the communicating means 370, may be protruded from a central portion of the pipe 410. Accordingly, when the pipe 410 is connected with the outlet member 366, the protrusion 412 arranged in the pipe 410 pushes the communicating means 370 toward the interior of the cartridge 300. As a result, the communicating means 370 moves toward the inner portion 362 of the outlet member 360 against the elastic force of the elastic member 364. As the communicating means 370 moves toward the inner portion 362, the inner sealing member 376 moves toward the inner portion 362 because the communicating means 370 and inner sealing member 376 are operatively connected. In accordance with the movement of the communicating means 370 and inner sealing member 376, a space is formed between the inner sealing member 376 and the step 367. Thus, water can flow through the space defined between the adjacent guide blades 378 and the space defined between the inner sealing member 376 and the step 367.

Again referring to FIG. 4, the valve unit 380 may further include a fixing member, for example, a stopper 390, to prevent the elastic member 364 from being separated from the valve unit 380 when the pipe member 342 is separated from the outlet member 360. The stopper 390 may be forcibly fitted in an inner end of the inner portion 362.

Once the stopper 390 is fitted in the inner end of the inner portion 362, as shown in FIG. 4, one end of the elastic member 364 may be supported by the communicating means 370, and the other end of the elastic member 364 may be supported by the stopper 390. Accordingly, even when the pipe member 342 is separated from the inner portion 362, the elastic member 364 cannot be separated from the inner portion 362. Although not shown, openings are formed through the stopper 390, to form passages, through which water can pass.

Hereinafter, operation of the laundry machine having the above-described configuration will be described in brief.

Before operating the laundry machine, the user separates the cartridge 300 from the cabinet 10, fills water in the cartridge 300, and then mounts the cartridge 330 to the cabinet 10.

As the laundry machine is subsequently operated, to supply moisture or steam, water is supplied from the cartridge 300 to the steam generator 200 in accordance with an operation of the pump 400. The supplied water is heated in the steam generator 200, to generate steam. The steam is then supplied to the drum 20.

Figure 7:
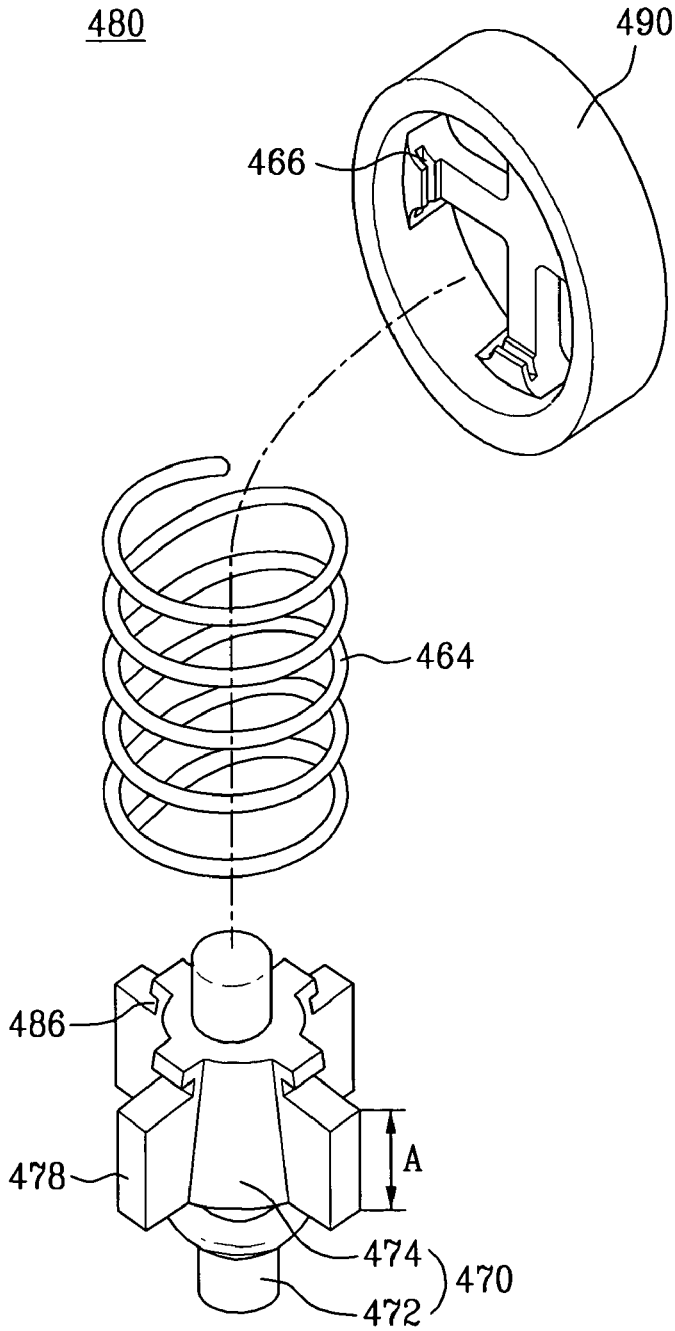
FIG. 7 is an exploded perspective view illustrating an exploded state of a valve unit according to an embodiment different from that of FIG. 3.
Figure 8:
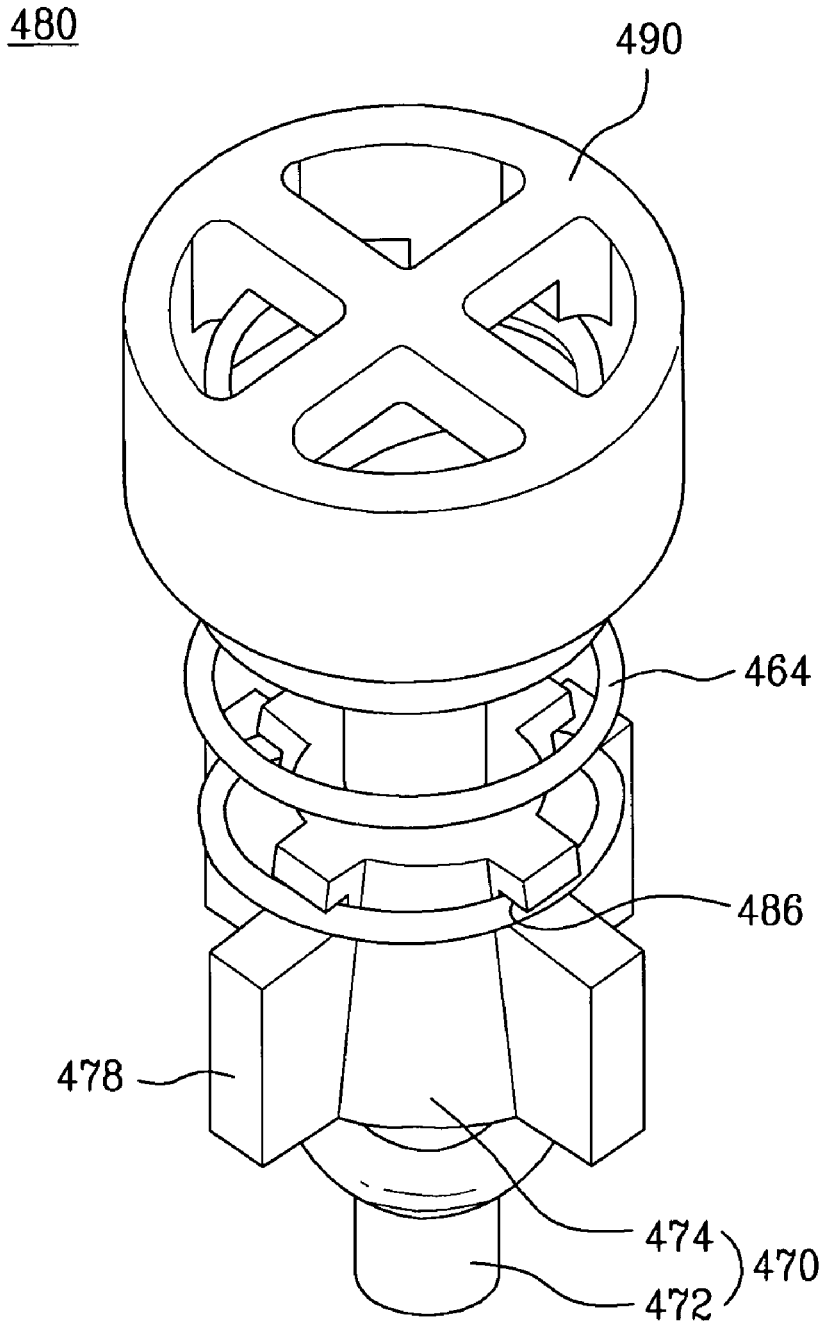
FIG. 8 is an assembled perspective view illustrating an assembled state of the valve unit shown in FIG. 7.

FIG. 7 is an exploded perspective view illustrating an exploded state of a valve unit according to an embodiment different from that of FIG. 3. FIG. 8 is an assembled perspective view illustrating an assembled state of the valve unit shown in FIG. 7.

The valve unit according to the embodiment of FIGS. 7 and 8 is different from the previous embodiment in that the communicating means, elastic member, and stopper are coupled together to form an assembly. Hereinafter, the valve unit will be described mainly in conjunction with the difference.

Referring to FIGS. 7 and 8, the valve unit 480 according to this embodiment includes a communicating means 470, an elastic member 464, and a stopper 490, which may be coupled together to form an assembly.

To this end, an engagement groove 486 is formed at one side of each guide blade 478 arranged at a guide portion 474, to engage with one end of the elastic member 464, and thus to fix one end of the elastic member 464. By the engagement grooves 486 of the guide blades 478, the elastic member 464 and communicating means 470 can be coupled to each other. Also, engagement steps 466 are formed at an inner surface of the stopper 490, to define grooves to engage with the other end of the elastic member 464, and thus to fix the other end of the elastic member 464.

Thus, one end of the elastic member 464 is engaged in the engagement grooves 486 formed at the guide portion 474, and the other end of the elastic member 464 are engaged in the engagement grooves defined by the engagement steps 466 formed at the stopper 490. Thus, the elastic member 464, communicating means 470, and stopper 490 are coupled together to form an assembly.

Accordingly, when it is desired to mount the elastic member 464, communicating means 470, and stopper 490, the user can achieve the mounting process at one time by mounting the assembly of the elastic member 464, communicating means 470, and stopper 490 without individually mounting the elastic member 464, communicating means 470, and stopper 490. Thus, the mounting process can be easily achieved. Also, an enhancement in workability can be achieved.

Although the present invention has been described mainly in conjunction with embodiments associated with a front loading type, in which objects to be dried are loaded through the front side of the laundry machine, it is not limited thereof. For example, the present invention is applicable to a top loading type in which objects to be dried are loaded through the top of the laundry machine.

Also, although the present invention has been described mainly in conjunction with embodiments associated with the case, in which a water supply device, namely, the cartridge 300, is separably installed in the cabinet 10, it is not limited thereof. The present invention is applicable to the case in which the water supply device is fixedly installed in the cabinet 10.

As apparent from the above description, the laundry machine according to the present invention provides the following effects.

The laundry machine according to the present invention can effectively remove creases or rumples possibly formed on clothes without performing ironing because steam is sprayed onto the clothes in a completely-dried state of the clothes.

In accordance with the present invention, it is possible to supply water from the cartridge only when the cartridge is in a state of being connected to the substance supply device.

In accordance with the present invention, the valve unit is arranged in the flow passage of the cartridge, and the inner sealing member is arranged such that it is operatively connected to the communicating means of the valve unit. Accordingly, it is possible to prevent the inner sealing member from closing the flow passage during a movement of the communicating means.

In accordance with the present invention, an integrated valve unit may be arranged in the flow passage of the cartridge. In this case, it is possible to easily install the valve unit, and thus to achieve an enhancement in workability.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a drum rotatably provided in a cabinet;

a substance supply device provided in the cabinet and supplying moisture to the drum wherein the substance supply device comprises a steam generator generating steam, and supplying steam to the drum;

a water supply device supplying water to the substance supply device;

a valve unit provided in the water supply device, to selectively allow water from the water supply device to be supplied to the substance supply device; and a pump provided between the steam generator and the water supply device, wherein the water supply device is detachably connected to the pump, and the valve unit allows water to pass through the valve unit when the water supply device is connected to the pump.

2. The laundry machine according to claim 1, further comprising a heater heating air, to supply hot air into the drum.

3. The laundry machine according to claim 1, wherein the valve unit comprises:

a communicating means for communicating an interior of the water supply device with an outside of the water supply device, to selectively open/close the flow passage; and an elastic member applying an elastic force to the communicating means.

4. The laundry machine according to claim 3, wherein the valve unit further comprises:

an inner sealing member operatively connected to the communicating means.

5. The laundry machine according to claim 4, wherein the communicating means comprises:

an actuating portion to selectively open/close the flow passage; and a guide portion extending from the actuating portion and having passages, through which water can pass.

6. The laundry machine according to claim 5, wherein the guide portion comprises a plurality of guide blades extending radially while being circumferentially spaced apart from one another.

7. The laundry machine according to claim 6, wherein the guide blades arrange the communicating means along a central portion of the flow passage, and to define the passages.

8. The laundry machine according to claim 7, wherein each of the guide blades have a width in a water flow direction corresponding to ⅓ to ⅔ of the predetermined distance, by which the communicating means is movable in the flow passage.

9. The laundry machine according to claim 5, wherein the communicating means further comprises an annular groove formed between the actuating portion and the guide portion, and the inner sealing member is fitted around the annular groove.

10. The laundry machine according to claim 3, wherein the valve unit further comprises a fixing member fixing the elastic member and preventing the elastic member from being separated.

11. The laundry machine according to claim 10, wherein the elastic member has an end supported by the communicating means, and an opposite end supported by the fixing member.

12. The laundry machine according to claim 11, wherein the fixing member is forcibly fitted in one end of the flow passage.

13. The laundry machine according to claim 12, wherein the fixing member is formed with an opening, through which water can pass.

14. The laundry machine according to claim 13, wherein the elastic member has an end fixed by the communicating means, and an opposite end fixed by the fixing member.

15. The laundry machine according to claim 14, wherein the communicating means and the fixing member are formed with engagement grooves to engage with the ends of the elastic member, respectively.

* * * * *